US011053561B2

(12) United States Patent
Miyata et al.

(10) Patent No.: US 11,053,561 B2
(45) Date of Patent: Jul. 6, 2021

(54) HIGH-STRENGTH STEEL SHEET

(71) Applicant: Kobe Steel, Ltd., Kobe (JP)

(72) Inventors: Ryota Miyata, Kakogawa (JP); Tetsuo Yamaguchi, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 826 days.

(21) Appl. No.: 15/505,666

(22) PCT Filed: Aug. 26, 2015

(86) PCT No.: PCT/JP2015/073938

§ 371 (c)(1),
(2) Date: Feb. 22, 2017

(87) PCT Pub. No.: WO2016/039136

PCT Pub. Date: Mar. 17, 2016

(65) Prior Publication Data

US 2017/0275718 A1 Sep. 28, 2017

(30) Foreign Application Priority Data

Sep. 11, 2014 (JP) ..... JP2014-185084

(51) Int. Cl.

| | |
|---|---|
| ***C21D 8/02*** | (2006.01) |
| ***C22C 38/22*** | (2006.01) |
| ***C22C 38/00*** | (2006.01) |
| ***C22C 38/54*** | (2006.01) |
| ***C22C 38/32*** | (2006.01) |

(52) U.S. Cl.

CPC ..... *C21D 8/0205* (2013.01); *C21D 8/0226* (2013.01); *C22C 38/00* (2013.01); *C22C 38/22* (2013.01); *C22C 38/32* (2013.01); *C22C 38/54* (2013.01); *C21D 8/02* (2013.01)

(58) Field of Classification Search

CPC ..... C21D 8/02; C21D 8/0205; C21D 8/0226; C22C 38/00; C22C 38/22; C22C 38/32; C22C 38/54

See application file for complete search history.

(56) References Cited

U.S. PATENT DOCUMENTS

2015/0225822 A1* 8/2015 Miura ..... C22C 38/60 148/330

FOREIGN PATENT DOCUMENTS

| | | | |
|---|---|---|---|
| JP | 56-14127 | A | 2/1981 |
| JP | 63-169359 | A | 7/1988 |
| JP | 9-118950 | A | 5/1997 |
| JP | 2005-179783 | A | 7/2005 |
| JP | 2012-36499 | A | 2/2012 |
| JP | 2013-104124 | A | 5/2013 |
| JP | 2014-29003 | A | 2/2014 |
| WO | WO 2014/045553 | A1 | 3/2014 |

OTHER PUBLICATIONS

English translation of International Preliminary Report on Patentability dated Mar. 14, 2017 in PCT/JP2015/073938 filed Aug. 26, 2015.

International Search Report dated Nov. 24, 2015, in PCT/JP2015/073938, filed Aug. 26, 2015.

* cited by examiner

*Primary Examiner* — Jenny R Wu

(74) *Attorney, Agent, or Firm* — Oblon, McClelland, Maier & Neustadt, L.L.P.

(57) ABSTRACT

Provided is a steel sheet with excellent abrasion resistance as well as excellent low-temperature toughness and ductility of a base material while having a high strength of a tensile strength of 1,100 MPa or more. The steel sheet is a high-strength steel sheet having a tensile strength of 1,100 MPa or more, wherein the components in the steel satisfy a defined composition, A-value represented by a defined formula (1) is 0.0015 or less, while E-value represented by a defined formula (3) is 0.95 or more, and a Brinell hardness HBW (10/3000) in a position at a depth of 2 mm from a surface of the steel sheet is 360 or more and 440 or less.

11 Claims, No Drawings

HIGH-STRENGTH STEEL SHEET

TECHNICAL FIELD

The present invention relates to a high-strength steel sheet. More specifically, the present invention relates to a high-strength steel sheet exhibiting excellent low-temperature toughness and ductility and having a tensile strength of 1,100 MPa or more. The high-strength steel sheet of the present invention is suitably used as a thick steel sheet in applications, including construction machines and industrial machines.

BACKGROUND ART

Thick steel sheets used for construction machines, industrial machines and the like are required to demonstrate higher strength performance with recent increasing demands for lighter products. The thick steel sheets used for the above-mentioned applications also need the high toughness of a base material, especially high low-temperature toughness of the base material in view of usage in cold districts. However, in general, the strength tends to conflict with the toughness. The higher the strength, the lower the toughness becomes. Techniques for enhancing the strength, the toughness of the base material and the like are disclosed, for example, in the following Patent Documents 1 to 4.

Patent Document 1 discloses a technique for providing a steel sheet with excellent low-temperature toughness while maintaining a high tensile strength of 1,100 MPa class or more. In Patent Document 1, the high strength and toughness of the steel sheet are achieved by controlling contents of Al and N to reduce inclusions.

Patent Document 2 also discloses a technique for providing a steel sheet with excellent low-temperature toughness while maintaining a high tensile strength of 1,100 MPa class. Patent Document 2 achieves the high strength and toughness by adding 0.20% or more of C and controlling heating temperature to refine γ grains.

Patent Document 3 discloses a technique for providing a steel sheet with excellent weldability while maintaining a high tensile strength of 1,100 MPa class. In Patent Document 3, the addition of a rare-earth element ensures the above-mentioned weldability.

Patent Document 4 discloses a technique for providing a steel sheet with excellent low-temperature toughness while maintaining a high tensile strength of 1,100 MPa class. In Patent Document 4, a carbon equivalent Ceq and hardenability are controlled to achieve a desired purpose.

PRIOR ART DOCUMENT

Patent Document

Patent Document 1: JP S63-169359 A
Patent Document 2: JP H09-118950 A
Patent Document 3: JP S56-14127 A
Patent Document 4: JP 2005-179783 A

SUMMARY OF THE INVENTION

Problems to be Solved by the Invention

Thick steel sheets are also required to have high ductility as well as high strength and low-temperature toughness in view of bending work when manufacturing a construction machine and the like. The above-mentioned Patent Documents 1 to 4 disclose steel sheets with improved strength, low-temperature toughness, weldability and the like, but fail to consider the ductility of the steel sheet and do not disclose any means for improving the ductility.

Furthermore, the thick steel sheet used for construction machines, industrial machines and the like is also required to exhibit excellent abrasion resistance. In general, the abrasion resistance of the thick steel sheet is correlated with hardness thereof. The thick steel sheet that would be susceptible to abrasion needs to increase its hardness.

The present invention has been made under the circumstances as described above, and it is an object of the present invention to provide a steel sheet with excellent abrasion resistance as well as excellent low-temperature toughness and ductility while having a high tensile strength of 1,100 MPa or more. The term "low-temperature toughness" as used hereinafter can be simply referred to as "toughness" in some cases.

Means for Solving the Problems

A high-strength steel sheet of the present invention that can solve the above-mentioned problems is a high-strength steel sheet having a high tensile strength of 1,100 MPa or more, including by mass %:

C: 0.13 to 0.17%;
Si: 0.1 to 0.5%;
Mn: 1.0 to 1.5%;
P: more than 0% and 0.02% or less;
S: more than 0% and 0.0020% or less;
Cr: 0.50 to 1.0%;
Mo: 0.20 to 0.6%;
Al: 0.030 to 0.005%;
B: 0.0003 to 0.0030%;
Nb: 0% or more and 0.030% or less; and
N: more than 0% and 0.0060% or less, with the balance being iron and inevitable impurities, wherein, A-value represented by formula (1) below is 0.0015 or less, E-value represented by formula (3) below is 0.95 or more, and a Brinell hardness HBW (10/3000) of the steel sheet in a position at a depth of 2 mm from a surface of the steel sheet is 360 or more and 440 or less, $$A\text{-value}=10^{D}\times[S] \quad (1),$$

where, in the formula (1), [S] is a content of S in the steel by mass %, and D is a value represented by formula (2) below, $$D=0.1\times[C]+0.07\times[Si]-0.03\times[Mn]+0.04\times[P]-0.06\times[S]+0.04\times[Al]-0.01\times[Ni]+0.10\times[Cr]+0.003\times[Mo]-0.020\times[V]-0.010\times[Nb]+0.15\times[B] \quad (2),$$

where, in the formula (2), [ ] indicates a content of each element in the steel by mass %, and a content of an element not contained in the steel is defined as 0% by mass in calculation, and $$E\text{-value}=1.16\times([C]/10)^{0.5}\times(0.7\times[Si]+1)\times(3.33\times[Mn]+1)\times(0.35\times[Cu]+1)\times(0.36\times[Ni]+1)\times(2.16\times[Cr]+1)\times(3\times[Mo]+1)\times(1.75\times[V]+1)\times(200\times[B]+1)/(0.1\times t) \quad (3),$$

where, in the formula (3), [ ] indicates a content of each element in the steel by mass %, t is a thickness of the steel sheet represented in units of mm, and a content of an element not contained in the steel is defined as 0% by mass in calculation.

The components in the steel of the high-strength steel sheet may further include, as other elements, by mass: one or more elements selected from a group consisting of Cu: more than 0% and 1.5% or less; V: more than 0% and 0.20% or less; and Ni: more than 0% and 1.0% or less.

Effects of the Invention

The high-strength steel sheet of the present invention is constituted as mentioned above, and thus exhibits excellent abrasion resistance as well as excellent low-temperature toughness and ductility while having a high tensile strength of 1,100 MPa or more.

MODE FOR CARRYING OUT THE INVENTION

First of all, the present inventors have found that a reduction of area (RA) in a tensile test as one index of ductility should be set at 60% or more to ensure good bending workability required for manufacturing construction machines and the like. Furthermore, the present inventors have diligently studied in order to obtain a steel sheet that can achieve RA 60% as well as the high strength and excellent low-temperature toughness. As a result, the present inventors have found that by controlling A-value and E-value to be mentioned below to satisfy specific ranges while appropriately controlling each content of the components in the steel, the low-temperature toughness and the ductility of the steel sheet can be further improved, compared with the case that only each content of components in the steel are specified in other words, found that in order to obtain the desired properties, the following A-value and E-value as well as each component in the steel need to be appropriately controlled, and then arrived at the present invention. The present invention will be described below, starting from the components in the steel of the present invention.

C: 0.13 to 0.17%

Carbon (C) is an element essential to ensure the strength and hardness of the base material (steel sheet). To effectively exhibit such effects, the lower limit of the amount of C is set at 0.13% or more. The amount of C is preferably 0.135% or more. However, an excessive amount of C causes the Brinell hardness HBW of the base material to exceed 440. Thus, the upper limit of the amount of C content is set at 0.17% or less. The upper limit of the amount of C is preferably 0.165% or less, and more preferably 0.160% or less.

Si: 0.1 to 0.5%

Silicon (Si) has a deoxidation function and is effective in improving the strength of the base material. To effectively exhibit such effects, the lower limit of the amount of Si is set at 0.1% or more. The lower limit of the amount of Si is preferably 0.20% or more, and more preferably 0.25% or more. However, an excessive amount of Si degrades the weldability of the steel sheet. Thus, the upper limit of the amount of Si is set at 0.5% or less. The upper limit of the amount of Si is preferably 0.40% or less.

Mn: 1.0 to 1.5%

Manganese (Mn) is an element effective in improving the strength of the base material. To effectively exhibit such effect, the lower limit of the amount of Mn is set at 1.0% or more. The lower limit of the amount of Mn is preferably 1.10% or more. However, an excessive amount of Mn degrades the weldability. Thus, the upper limit of the amount of Mn is set at 1.5% or less. The upper limit of the amount of Mn is preferably 1.4% or less, and more preferably 1.3% or less.

P: More than 0% and 0.02% or Less

Phosphorus (P) is an element inevitably contained in the steel. An excessive amount of P degrades the toughness of the steel sheet. The upper limit of the amount of P is set at 0.02%. The smaller amount of P is preferable, and the upper limit of the amount of P is preferably 0.015% or less, and more preferably 0.010% or less. It is difficult to set the amount of P at zero. Thus, the lower limit of the amount of P exceeds 0%.

S: More than 0% and 0.0020% or Less

Sulfur (S) is an element inevitably contained in the steel. An excessive amount of S causes formation of a large amount of MnS to degrade the toughness of the steel sheet. Thus, the upper limit of the amount of S is set at 0.0020% or less. The smaller amount of S is preferable, and the upper limit of the amount of S is preferably 0.0015% or less. It is difficult to set the amount of S at zero. Thus, the lower limit of the amount of S exceeds 0%.

Cr: 0.50 to 1.0%

Chromium (Cr) is an element effective in improving the strength of the base material. To effectively exhibit such effect, the lower limit of the amount of Cr is set at 0.50% or more. The lower limit of the amount of Cr content is preferably 0.55% or more, and more preferably 0.60% or more. On the other hand, an excessive amount of Cr degrades the weldability of the steel sheet. Thus, the upper limit of the amount of Cr is set at 1.0% or less. The upper limit of the amount of Cr is preferably 0.90% or less, and more preferably 0.85% or less.

Mo: 0.20 to 0.6%

Molybdenum (Mo) is an element effective in improving the strength and hardness of the base material. To effectively exhibit such effects, the lower limit of the amount of Mo is set at 0.20% or more. The lower limit of the amount of Mo is preferably 0.25% or more. However, an excessive amount of Mo degrades the weldability of the steel sheet. Thus, the upper limit of the amount of Mo is set at 0.6% or less. The upper limit of the amount of Mo is preferably 0.55% or less, and more preferably 0.50% or less.

Al: 0.030 to 0.085%

Aluminum (Al) is an element used for deoxidation. To effectively exhibit such effect, the lower limit of the amount of Al is set at 0.030% or more. However, an excessive amount of Al causes formation of coarse Al-based inclusions to degrade the toughness of the steel sheet. Thus, the upper limit of the amount of Al is set at 0.085% or less. The upper limit of the amount of Al is preferably 0.080% or less.

B: 0.0003 to 0.0030%

Boron (B) is an element that is effective in improving the hardenability and strengths of the base material and a weld zone (heat-affected zone (HAZ)). To effectively exhibit such effects, the lower limit of the amount of B is set at 0.0003% or more. The lower limit of the amount of B is preferably 0.0005% or more.

However, an excessive amount of B causes precipitation of boron carbides to degrade the toughness of the steel sheet. Thus the upper limit of the amount of B is set at 0.0030% or less. The upper limit of the amount of B is preferably 0.0020% or less, and more preferably 0.0015% or less.

Nb: 0% or More and 0.030% or Less

Niobium (Nb) is solid-soluted during heating of a slab, and precipitated as fine niobium carbides when reheated after rolling and cooling. In this way, Nb serves as an element effective in refining austenite grains to enhance the toughness of the steel sheet. To sufficiently exhibit these effects, the amount of Nb is preferably 0.005% or more, and more preferably 0.010% or more. However, an excessive amount of Nb causes coarsening of precipitates and then causes degradation of the toughness of the steel sheet. Thus, the upper limit of the amount of Nb is set at 0.030% or less. The upper limit of the amount of Nb is preferably 0.025% or less.

N: More than 0% and 0.0060% or Less

Nitrogen (N) is an element inevitably contained in the steel. An excessive amount of N degrades the toughness of the steel sheet in the presence of solid-solution N. Thus, the upper limit of the amount of N is set at 0.0060% or less. The smaller amount of N is preferable, and the upper limit of the amount of N is preferably 0.0055% or less, and more preferably 0.0050% or less. It is difficult to set the amount of N at zero. Thus, the lower limit of the amount of N exceeds 0%.

The high-strength steel sheet of the present invention satisfies the above-mentioned components in the steel, with the balance being iron and inevitable impurities. To further improve the strength and toughness of the base material, one or more elements selected from a group consisting of Cu, V and Ni may be contained in the following amounts. These elements may be used alone or in combination.

Cu: More than 0% and 1.5% or Less

Copper (Cu) is an element effective in improving the strength and toughness of the base material. To effectively exhibit such effects, the lower limit of the amount of Cu is preferably 0.05% or more, and more preferably 0.10% or more. However, an excessive amount of Cu degrades the weldability of the steel sheet. Thus, the upper limit of the amount of Cu is preferably 1.5% or less, more preferably 1.4% or less, and further preferably 1.0% or less.

V: More than 0% and 0.20% or Less

Vanadium (V) is an element effective in improving the strength and toughness of the base material. To effectively exhibit such effects, the lower limit of the amount of V is preferably 0.01% or more, and more preferably 0.02% or more. However, an excessive amount of V degrades the weldability of the steel sheet. Thus, the upper limit of the amount of V is preferably 0.20% or less, more preferably 0.18% or less, and further preferably 0.15% or less.

Ni: More than 0% and 1.0% or Less

Nickel (Ni) is an element effective in improving the strength and toughness of the base material. To effectively exhibit such effects, the lower limit of the amount of Ni is preferably 0.05% or more, and more preferably 0.10% or more. However, an excessive amount of Ni degrades the weldability of the steel sheet. Thus, the upper limit of the amount of Ni is preferably 1.0% or less, and more preferably 0.8% or less.

The high-strength steel sheet of the present invention does not contain Ti. This is because the addition of Ti reduces the toughness and ductility of the steel sheet in a high-strength range of 1,100 MPa or more.

[A-value represented by formula (1) below is 0.0015 or less]

$$A\text{-value}=10^{D}\times[S] \quad (1),$$

where, in the formula (1), [S] is a content of S in the steel by mass %, and D is a value represented by formula (2) below, $$D=0.1\times[C]+0.07\times[Si]-0.03\times[Mn]+0.04\times[P]-0.06\times[S]+0.04\times[Al]-0.01\times[Ni]+0.10\times[Cr]+0.003\times[Mo]-0.020\times[V]-0.010\times[Nb]+0.15\times[B] \quad (2),$$

where, in the formula (2), [ ] indicates a content of each element in the steel by mass %, and a content of an element not contained in the steel is defined as 0% by mass in calculation.

The reason why the above formula (1) is defined is as follows. The present inventors have diligently studied means for improving the toughness and ductility of a steel sheet and have arrived at that the suppression of formation of MnS is particularly effective. From the viewpoint of suppressing the formation of MnS, suppressing of the amount of S in the steel is examined, and elements other than S are also examined in terms of the easiness to form MnS. Consequently, the present inventors have indicated the degree of influence to the formation of MnS by coefficients for the respective elements and have defined the above formula (1).

The present inventors have also found that the A-value represented by the above formula (1) obtained in this way is correlated with the toughness and ductility and have further examined the range of A-values for achieving the desired low-temperature toughness and ductility as evaluated in Examples to be mentioned later. As a result, the present inventors have found that the A-value should be 0.0015 or less. The A-value mentioned above is preferably 0.00140 or less, more preferably 0.00130 or less, and further preferably 0.00120 or less. The lower limit of A-value is not particularly limited, but should be approximately 0.00050 in view of the composition defined by the present invention. In the following, $10^{D}$ in the above formula (1) can be represented by "F-value" in some cases.

[E-value represented by formula (3) below is 0.95 or more]

$$E\text{-value}=1.16\times([C]/10)^{0.5}\times(0.7\times[Si]+1)\times(3.33\times[Mn]+1)\times(0.35\times[Cu]+1)\times(0.36\times[Ni]+1)\times(2.16\times[Cr]+1)\times(3\times[Mo]+1)\times(1.75\times[V]+1)\times(200\times[B]+1)/(0.1\times t) \quad (3),$$

where, in the formula (3), [ ] indicates a content of each element in the steel by mass %, t is a thickness of the steel sheet represented in units of mm, and a content of an element not contained in the steel is defined as 0% by mass in the calculation.

The formula (3) is a formula that defines DI indicative of the hardenability in view of the thickness of the steel sheet, and that defines DI so as to control it depending on the thickness of the steel sheet. The present inventors have found that the E-value represented by the above formula (3) is correlated with, especially, the strength and low-temperature toughness, and have examined the range of the E-values for achieving the desired strength and low-temperature toughness as evaluated in Examples to be mentioned later. As a result, the present inventors have found that when the above-mentioned E-value is 0.95 or more, the desired strength and low-temperature toughness of the steel sheet can be achieved. The E-value is preferably 1.00 or more, and more preferably 1.05 or more. The upper limit of the E-value is not particularly limited, but should be approximately 4.0 in view of the composition defined by the present invention.

The high-strength steel sheet of the present invention further has excellent abrasion resistance. To that end, the high-strength steel sheet needs to satisfy the Brinell hardness HBW (10/3000) of 360 or more in the position at a depth of 2 mm from a surface of the steel sheet. The term "position at a depth of 2 mm from a surface of the steel sheet" as used herein means the position at a depth of 2 mm from the surface of the steel sheet in the thickness direction. The above-mentioned Brinell hardness is preferably 365 or more, and more preferably 370 or more. On the other hand, an extremely high Brinell hardness reduce the ductility and low-temperature toughness of the steel sheet. Thus, the upper limit of Brinell hardness is set at 440 or less. The Brinell hardness is preferably 435 or less, and more preferably 430 or less. The above-mentioned term (10/3000) means the application of a pressure of 3,000 kgf by the use of a super high-alloy ball having a diameter of 10 mm as the measurement conditions of the Brinell hardness.

The compositions in the steel, A-value, E-value, and Brinell hardness characterizing the present invention have been described above. The term "thick steel sheet" as used herein means a steel sheet having a thickness of 6 mm or more.

The terms "low-temperature toughness" and "ductility" as used herein mean the low-temperature toughness and the ductility of the base material, respectively. The expression "excellent low-temperature toughness" as used herein means that $vE_{-40} \geq 50$ J is satisfied as shown in Examples to be mentioned later. The inventors have found that to appropriately perform bending work, as mentioned above, the reduction of area in the tensile test as one index of the ductility should be set at 60% or more. That is, the expression "excellent ductility" as used herein means that RA≥60% is satisfied. The term "excellent abrasion resistance" as used herein means that the Brinell hardness HBW (10/3000) of the steel sheet in a position at a depth of 2 mm from a surface of the steel sheet is 360 or more and 440 or less.

The manufacturing method for obtaining the steel sheet of the present invention is not particularly limited. The steel sheet of the present invention can be manufactured by using a molten steel that satisfies the composition of the present invention and performing hot-rolling and quenching. The hot-rolling may be performed under normal conditions (at heating temperature of 1,000° C. or higher, rolling temperature, and rolling reduction). The quenching is preferably performed by heating a steel sheet to 880° C. or higher to ensure the adequate hardenability.

The application claims the benefit of the right of priority based on the Japanese Patent Application No. 2014-185084 field on Sep. 11, 2014. The entire contents of the specification of the Japanese Patent Application No. 2014-185084 field on Sep. 11, 2014 is incorporated herein by reference.

EXAMPLES

Hereinafter, the present invention will be described more specifically with reference to examples. The present invention is not limited by the following examples, but can be naturally carried out by adding appropriate modifications thereto within a range that is suitable for the gist described above and below, and the modifications are included in the technical range of the present invention.

The thick steel sheets having the thicknesses shown in Table 2 were produced by using the steel having the composition shown in Table 1 and performing hot-rolling and quenching. The symbol "-" as shown in Table 1 means that no element is added. The F-values as shown in Table 2 is a value of $10^D$ in the defined formula (1).

The hot-rolling was performed by heating at 1,000 to 1,200° C. as mentioned below under the following conditions, and the hot-rolled sheets with the thicknesses shown in Table 2 were obtained.

(Conditions for Hot-Rolling)

Heating Temperature: 1,000 to 1,200° C.

Finish Temperature: 800 to 1,100° C.

Cooling Method: Air-Cooling

Then, the rolled sheets were heated to a temperature of $Ac_3$ point or higher, followed by quenching (Q), thus the thick steel sheets (Q steel sheets) were produced.

Respective steel sheets obtained in this way were evaluated for the following properties.

(1) Tensile Strength and Ductility

From respective steel sheets obtained in the above-mentioned way, No. 4 test pieces specified in JIS 22201 were taken. These test pieces were subjected to a tensile test by a method specified in JIS 22201 to measure the tensile strength and a reduction of area in fracture. In Table 2, "TS" is the tensile strength, and "RA" is the reduction of area. In Examples, the steel sheets having TS of 1,100 MPa or more were rated as having excellent high strength (Pass), and the steel sheets having RA of 60% or more were rated as having excellent ductility of the base material (Pass).

(2) Low-Temperature Toughness

Three test pieces, each having a 2 mm V-notch specified by JIS 22242, were taken in an L direction from each steel sheet obtained in the above-mentioned way in the t/4 position of its thickness. Each test piece was used and subjected to the Charpy impact test by a method specified by the JIS Z 2242 to measure an absorbed energy at −40° C. In Table 2, "$vE_{-40}$" indicates an absorbed energy at −40° C. In Examples, the steel sheet having an average value of 50 J or more of $vE_{-40}$ of three test pieces was rated as having excellent low-temperature toughness of a base metal (Pass).

(3) Brinell Hardness

The Brinell hardness of each steel sheet obtained in the above-mentioned way was measured in a position at a depth of 2 mm from its surface in the thickness direction. In detail, the surface of the steel sheet was scrapped, whereby a surface positioned at a depth of 2 mm from the surface of the steel sheet and in parallel to the surface of the steel sheet was formed as a measurement surface. In accordance with JIS 22243, the Brinell hardness was measured by applying a pressure of 3,000 kgf by the use of a super high-alloy ball having a diameter of 10 mm. The measurement of the Brinell hardness was performed three times, and then the average of these measurements was calculated. In Examples, the steel sheet having the Brinell hardness (average value) obtained in this way was 360 or more and 440 or less were rated as having excellent abrasion resistance (Pass).

These results are shown in Table 2.

TABLE 1

| Sample | Composition* (by mass %) | | | | | | | | | | | | | |
|---|---|---|---|---|---|---|---|---|---|---|---|---|---|---|
| No. | C | Si | Mn | P | S | Cr | Mo | Al | B | Nb | N | Cu | V | Ni |
| 1 | 0.154 | 0.35 | 1.20 | 0.005 | 0.0006 | 0.79 | 0.50 | 0.066 | 0.0009 | 0.020 | 0.0039 | — | — | — |
| 2 | 0.146 | 0.35 | 1.20 | 0.005 | 0.0012 | 0.74 | 0.44 | 0.065 | 0.0008 | 0.020 | 0.0044 | — | — | — |
| 3 | 0.151 | 0.25 | 1.09 | 0.006 | 0.0008 | 0.79 | 0.37 | 0.069 | 0.0008 | — | 0.0036 | 0.22 | 0.040 | 0.31 |
| 4 | 0.157 | 0.25 | 1.10 | 0.005 | 0.0012 | 0.79 | 0.36 | 0.072 | 0.0008 | 0.020 | 0.0058 | 0.24 | 0.039 | 0.31 |
| 5 | 0.141 | 0.35 | 1.20 | 0.005 | 0.0007 | 0.85 | 0.32 | 0.079 | 0.0010 | 0.019 | 0.0060 | — | — | — |
| 6 | 0.147 | 0.35 | 1.20 | 0.005 | 0.0003 | 0.74 | 0.43 | 0.066 | 0.0009 | 0.020 | 0.0049 | — | — | — |
| 7 | 0.146 | 0.35 | 1.20 | 0.005 | 0.0012 | 0.74 | 0.44 | 0.065 | 0.0008 | 0.020 | 0.0044 | — | — | — |
| 8 | 0.147 | 0.35 | 1.20 | 0.005 | 0.0003 | 0.74 | 0.43 | 0.066 | 0.0009 | 0.020 | 0.0049 | — | — | — |
| 9 | 0.146 | 0.35 | 1.20 | 0.005 | 0.0012 | 0.74 | 0.44 | 0.065 | 0.0008 | 0.020 | 0.0044 | — | — | — |

TABLE 1-continued

| Sample | Composition* (by mass %) | | | | | | | | | | | | | |
|---|---|---|---|---|---|---|---|---|---|---|---|---|---|---|
| No. | C | Si | Mn | P | S | Cr | Mo | Al | B | Nb | N | Cu | V | Ni |
| 10 | 0.130 | 0.22 | 1.05 | 0.005 | 0.0010 | 0.70 | 0.26 | 0.048 | 0.0009 | 0.017 | 0.0038 | — | 0.039 | — |
| 11 | 0.139 | 0.36 | 1.21 | 0.005 | 0.0006 | 0.15 | 0.32 | 0.081 | 0.0009 | 0.020 | 0.0056 | — | — | — |
| 12 | 0.220 | 0.35 | 1.22 | 0.005 | 0.0009 | 0.15 | 0.32 | 0.078 | 0.0010 | 0.021 | 0.0055 | — | — | — |
| 13 | 0.144 | 0.35 | 1.21 | 0.005 | 0.0009 | 0.15 | 0.32 | 0.076 | 0.0010 | 0.020 | 0.0057 | — | 0.069 | — |
| 14 | 0.146 | 0.36 | 1.20 | 0.005 | 0.0012 | 0.15 | 0.32 | 0.077 | 0.0011 | — | 0.0054 | — | — | — |
| 15 | 0.143 | 0.35 | 1.22 | 0.005 | 0.0012 | 0.15 | 0.32 | 0.077 | 0.0035 | 0.020 | 0.0059 | — | — | — |
| 16 | 0.156 | 0.25 | 1.10 | 0.005 | 0.0022 | 0.79 | 0.37 | 0.070 | 0.0008 | — | 0.0031 | 0.24 | 0.039 | 0.31 |
| 17 | 0.153 | 0.35 | 1.20 | 0.005 | 0.0022 | 0.76 | 0.32 | 0.082 | 0.0009 | 0.058 | 0.0054 | — | — | — |
| 18 | 0.147 | 0.35 | 1.21 | 0.005 | 0.0020 | 0.78 | 0.33 | 0.082 | 0.0008 | 0.020 | 0.0056 | — | 0.114 | — |
| 19 | 0.150 | 0.35 | 1.22 | 0.005 | 0.0014 | 0.77 | 0.32 | 0.083 | 0.0010 | 0.020 | 0.0058 | — | — | 0.55 |
| 20 | 0.154 | 0.35 | 1.22 | 0.005 | 0.0018 | 0.77 | 0.32 | 0.083 | 0.0008 | 0.020 | 0.0033 | — | — | — |
| 21 | 0.155 | 0.35 | 1.21 | 0.005 | 0.0019 | 0.77 | 0.32 | 0.081 | 0.0011 | 0.060 | 0.0062 | — | — | — |
| 22 | 0.149 | 0.35 | 1.20 | 0.005 | 0.0019 | 0.78 | 0.50 | 0.068 | 0.0009 | 0.019 | 0.0035 | — | — | — |
| 23 | 0.155 | 0.35 | 1.20 | 0.005 | 0.0020 | 0.79 | 0.49 | 0.080 | 0.0009 | — | 0.0059 | — | — | — |
| 24 | 0.155 | 0.35 | 1.20 | 0.005 | 0.0021 | 0.79 | 0.49 | 0.069 | 0.0009 | — | 0.0035 | — | — | — |
| 25 | 0.131 | 0.22 | 1.05 | 0.005 | 0.0010 | 0.70 | 0.26 | 0.048 | 0.0009 | 0.017 | 0.0038 | — | 0.039 | — |

*Balance: Iron and inevitable impurities other than P, S and N

TABLE 2

| Sample | | | | Thickness | | TS | RA | $vE_{-40}$ (J) | | | |
|---|---|---|---|---|---|---|---|---|---|---|---|
| No. | A-value | F-value | E-value | (mm) | HBW | (MPa) | (%) | 1 | 2 | 3 | Average |
| 1 | 0.00073 | 1.222 | 1.430 | 50 | 400 | 1280 | 61 | 89 | 78 | 51 | 73 |
| 2 | 0.00145 | 1.205 | 1.219 | 50 | 396 | 1234 | 62 | 23 | 48 | 88 | 53 |
| 3 | 0.00096 | 1.200 | 1.316 | 50 | 408 | 1152 | 65 | 85 | 164 | 93 | 114 |
| 4 | 0.00144 | 1.200 | 1.339 | 50 | 401 | 1210 | 60 | 70 | 52 | 53 | 58 |
| 5 | 0.00086 | 1.235 | 1.143 | 50 | 399 | 1130 | 66 | 77 | 33 | 45 | 52 |
| 6 | 0.00036 | 1.206 | 1.536 | 40 | 396 | 1216 | 62 | 45 | 72 | 71 | 63 |
| 7 | 0.00145 | 1.205 | 1.524 | 40 | 404 | 1218 | 63 | 78 | 92 | 95 | 88 |
| 8 | 0.00036 | 1.206 | 2.047 | 30 | 395 | 1264 | 62 | 79 | 53 | 65 | 66 |
| 9 | 0.00145 | 1.205 | 2.032 | 30 | 401 | 1241 | 62 | 43 | 50 | 70 | 54 |
| 10 | 0.00117 | 1.172 | 1.018 | 38 | 408 | 1115 | 71 | 56 | 67 | 50 | 58 |
| 11 | 0.00063 | 1.052 | 0.527 | 50 | 398 | 978 | 70 | 17 | 23 | 15 | 18 |
| 12 | 0.00096 | 1.069 | 0.675 | 50 | 461 | 1258 | 51 | 20 | 10 | 11 | 14 |
| 13 | 0.00094 | 1.048 | 0.608 | 50 | 399 | 1030 | 65 | 26 | 34 | 30 | 30 |
| 14 | 0.00127 | 1.055 | 0.555 | 50 | 393 | 904 | 70 | 13 | 11 | 22 | 15 |
| 15 | 0.00126 | 1.051 | 0.771 | 50 | 391 | 911 | 67 | 15 | 11 | 16 | 14 |
| 16 | 0.00264 | 1.200 | 1.354 | 50 | 390 | 1144 | 59 | 37 | 30 | 23 | 30 |
| 17 | 0.00267 | 1.213 | 1.091 | 50 | 398 | 1105 | 58 | 16 | 17 | 35 | 23 |
| 18 | 0.00242 | 1.210 | 1.309 | 50 | 393 | 1206 | 58 | 24 | 37 | 37 | 33 |
| 19 | 0.00168 | 1.199 | 1.344 | 50 | 382 | 1277 | 55 | 41 | 28 | 35 | 35 |
| 20 | 0.00219 | 1.215 | 1.099 | 50 | 382 | 1217 | 58 | 27 | 29 | 29 | 28 |
| 21 | 0.00231 | 1.215 | 1.152 | 50 | 397 | 1234 | 57 | 34 | 40 | 26 | 33 |
| 22 | 0.00231 | 1.218 | 1.395 | 50 | 395 | 1210 | 58 | 42 | 48 | 45 | 45 |
| 23 | 0.00245 | 1.224 | 1.417 | 50 | 389 | 1244 | 55 | 45 | 54 | 40 | 46 |
| 24 | 0.00257 | 1.223 | 1.417 | 50 | 402 | 1258 | 56 | 43 | 37 | 53 | 44 |
| 25 | 0.00117 | 1.172 | 0.777 | 50 | 410 | 985 | 66 | 20 | 25 | 33 | 44 |

As shown in Tables 1 and 2, each of sample Nos. 1 to 10 satisfied the composition, the A-value, and the E-value, defined by the present invention. Thus, these samples exhibited both the excellent low-temperature toughness and ductility, even though they have high strength of TS≥1,100 MPa. Furthermore, these samples had their Brinell hardness controlled appropriately, and thus exhibited excellent abrasion resistance.

In contrast, the following examples had disadvantages as mentioned later.

In Sample No. 11, the amount of Cr was lacking, and the E-value was low, resulting in insufficient strength of the steel sheet and in reduced low-temperature toughness thereof.

In Sample No. 12, the amount of C was excessive, the amount of Cr was lacking, and the E-value was also low, causing the Brinell hardness of the steel sheet to exceed the upper limit thereof, and degrading the ductility and low-temperature toughness of the steel sheet. In Sample No. 12, the E-value was low, but the amount of C was excessive, thus it is considered that the tensile strength was 1,100 MPa or more.

In Sample Nos. 13 to No. 15, the amount of Cr was lacking, and the E-value was also low, thus resulting in insufficient strength of the steel sheet and in reduced low-temperature toughness thereof. In Sample No. 15, the amount of B was excessive, resulting in significantly degraded low-temperature toughness of the steel sheet.

In Sample Nos. 16 and No. 24, the amount of S was excessive, and the A-value also exceeded the upper limit thereof, thus resulting in reduced ductility and low-temperature toughness of the steel sheet.

In Sample No. 17, the amount of S and the amount of Nb were excessive, and the A-value also exceeded the upper limit thereof, thus resulting in reduced ductility and low-temperature toughness of the steel sheet.

In Sample Nos. 18 to 20, the contents of the respective elements in the steels and the E-values were within defined ranges, but the A-value exceeded the upper limit thereof, thus resulting in reduced ductility and low-temperature toughness of the steel sheet.

In Sample No. 21, the amount of Nb and the amount of N were excessive, and the A-value exceeded the upper limit thereof, thus resulting in reduced ductility and low-temperature toughness of the steel sheet.

In Sample Nos. 22 and 23, the contents of the respective elements in the steels and the E-values were within defined ranges, but the A-value exceeded the upper limit thereof, thus resulting in reduced ductility and low-temperature toughness of the steel sheet.

In Sample No. 25, the contents of the respective elements in the steel and the A-value were within defined ranges, but the E-value was below the lower limit thereof, thus resulting in reduced strength and low-temperature toughness of the steel sheet.

The invention claimed is:

1. A high-strength steel sheet, comprising by mass %:
C: 0.13 to 0.17%;
Si: 0.1 to 0.5%;
Mn: 1.0 to 1.5%;
P: more than 0% and 0.02% or less;
S: more than 0% and 0.0020% or less;
Cr: 0.50 to 1.0%;
Mo: 0.20 to 0.6%:
Al: 0.030 to 0.085%:
B: 0.0003 to 0.0030%;
Nb: 0% or more and 0.030% or less;
N: more than 0% and 0.0060% or less; and
wherein,
A-value represented by formula (1) is 0.0015 or less,
E-value represented by formula (3) is 0.95 or more, and
a Brinell hardness HBW, 10/3000, of the steel sheet in a position at a depth of 2 mm from a surface of the steel sheet is 360 or more and 440 or less:

$$A\text{-value}=10^{D}\times[S] \quad (1),$$

where [S] is a content of S in the steel sheet by mass %, and D is a value represented by formula (2):

$$D=0.1\times[C]+0.07\times[Si]-0.03\times[Mn]+0.04\times[P]-0.06\times[S]+0.04\times[Al]-0.01\times[Ni]+0.10\times[Cr]+0.003\times[Mo]-0.020\times[V]-0.010\times[Nb]+0.15\times[B] \quad (2),$$

where [C], [Si], [Mn], [P], [S], [Al], [Ni] [Cr], [Mo], [V], [Nb], and [B] represent a content of C, Si, Mn, P, S, Al, Ni, Cr, Mo, V, Nb, and B in the steel sheet by mass %, respectively and a content of an element not contained in the steel sheet is defined as 0% by mass in the formula (2), $$E\text{-value}=1.16\times([C]/10)^{0.5}\times(0.7\times[Si]+1)\times(3.33\times[Mn]+1)\times(0.35\times[Cu]+1)\times(0.36\times[Ni]+1)\times(2.16\times[Cr]+1)\times(3\times[Mo]+1)\times(1.75\times[V]+1)\times(200\times[B]+1)/(0.1\times t) \quad (3),$$

where [C], [Si], [Mn], [Cu], [Ni], [Cr], [Mo], [V], and [B] represent a content of C, Si, Mn, Cu, Ni, Cr, Mo, V, and B in the steel sheet by mass %, respectively, t is a thickness of the steel sheet by mm, and a content of an element not contained in the steel is defined as 0% by mass in the formula (3).

2. The steel sheet according to claim 1, comprising by mass %: one or more elements selected from the group consisting of
Cu: more than 0% and 1.5% or less;
V: more than 0% and 0.20% or less; and
Ni: more than 0% and 1.0% or less of Ni.

3. The steel sheet according to claim 1, which has a tensile strength of 1,100 MPa or more.

4. The steel sheet according to claim 1, comprising by mass %:
C: 0.135 to 0.165%;
Si: 0.2 to 0.4%;
Mn: 1.20 to 1.4%;
P: more than 0% and 0.015% or less;
S: more than 0% and 0.0015% or less;
Cr: 0.55 to 0.90%;
Mo: 0.25 to 0.55%;
Al: 0.048 to 0.080%;
B: 0.0005 to 0.0020%;
Nb: 0.005% or more and 0.025% or less; and
N: more than 0% and 0.0055% or less.

5. The steel sheet according to claim 1, comprising by mass %:
C: 0.135 to 0.160%;
Si: 0.25 to 0.4%;
Mn: 1.10 to 1.3%;
P: more than 0% and 0.010% or less;
S: more than 0.0006% and 0.0020% or less;
Cr: 0.60 to 0.85%;
Mo: 0.25 to 0.50%;
Al: 0.030 to 0.085%;
B: 0.0005 to 0.0015%;
Nb: 0.010% or more and 0.025% or less; and
N: more than 0% and 0.0050% or less.

6. The steel sheet according to claim 1, wherein A-value represented by formula (1) is 0.00140 or less.

7. The steel sheet according to claim 1, wherein the A-value represented by formula (1) is 0.00120 or less.

8. The steel sheet according to claim 1, wherein the E-value represented by formula (3) is 1.00 to about 4.0.

9. The steel sheet according to claim 1, wherein the E-value represented by formula (3) is 1.05 to about 4.0.

10. The steel sheet according to claim 1, wherein the Brinell hardness HBW, 10/3000, of the steel sheet in a position at a depth of 2 mm from a surface of the steel sheet is 365 to 435.

11. The steel sheet according to claim 1, wherein the Brinell hardness HBW, 10/3000, of the steel sheet in a position at a depth of 2 mm from a surface of the steel sheet is 370 to 430.

* * * * *